US005090313A

United States Patent [19]

Chapman

[11] Patent Number: 5,090,313

[45] Date of Patent: Feb. 25, 1992

[54] MULTI-COLOR SILK SCREEN PRINTER HAVING SEPARABLE TWO-PIECE PLATEN FOR REMOVAL AND REPLACEMENT OF PRINTED MATERIAL WITHOUT LOSS OF REGISTRY

[75] Inventor: Jeffrey S. Chapman, McMinnville, Oreg.

[73] Assignee: Textile Graphics Unlimited, Inc., McMinnville, Oreg.

[21] Appl. No.: 547,011

[22] Filed: Jul. 2, 1990

[51] Int. Cl.[5] ..... B41M 1/12

[52] U.S. Cl. ..... 101/129; 101/115; 101/126

[58] Field of Search ..... 101/114, 115, 126, 129

[56] References Cited

U.S. PATENT DOCUMENTS

| | | | |
|---|---|---|---|
| 2,782,574 | 2/1957 | Copold | 101/126 |
| 2,846,946 | 8/1958 | Schwarzberger | 101/115 |
| 4,031,825 | 6/1977 | Jaffa | 101/126 |
| 4,268,545 | 5/1981 | Hodulik | 101/129 |
| 4,583,458 | 3/1986 | Beachum | 101/126 |
| 4,735,139 | 3/1988 | Szarka | 101/126 |
| 4,819,559 | 3/1989 | Szarka | 101/126 X |
| 4,846,058 | 7/1989 | Farris | 101/126 |
| 4,875,268 | 10/1989 | Szarka | 101/126 X |

FOREIGN PATENT DOCUMENTS

| | | | |
|---|---|---|---|
| 0340822 | 11/1989 | European Pat. Off. | 101/115 |
| 2572026 | 3/1986 | France | 101/129 |
| 0134256 | 6/1986 | Japan | 101/129 |
| 1178627 | 9/1985 | U.S.S.R. | 101/126 |
| 2069412 | 8/1981 | United Kingdom | 101/129 |

*Primary Examiner*—Edgar S. Burr
*Assistant Examiner*—Christopher A. Bennett
*Attorney, Agent, or Firm*—Chernoff, Vilhauer, McClung & Stenzel

[57] ABSTRACT

An apparatus for making multi-color silk screen prints on dimensionally unstable material such as T-shirts includes a platen, to which the shirt is adhesively affixed, that is removable from the remainder of the apparatus with a shirt attached to it without loss of registry between the shirt and silk screens carried by the apparatus when the platen is reinstalled on the apparatus. This permits moving the platen from one apparatus to another thereby printing more colors than would be possible with either apparatus alone. The apparatus also permits removing the shirt from the apparatus to perform a non-silk screen process between the printing of colors. In a preferred embodiment of the invention the removal of the platen is accomplished by dividing the platen into a bottom piece that is attached to the remainder of the apparatus and a top piece that is releasably attached to the bottom piece. Matching pins and holes in the platen pieces permit their separation and rejoinder without loss of registry, and also secure the two platen pieces immovably with respect to one another.

4 Claims, 3 Drawing Sheets

MULTI-COLOR SILK SCREEN PRINTER HAVING SEPARABLE TWO-PIECE PLATEN FOR REMOVAL AND REPLACEMENT OF PRINTED MATERIAL WITHOUT LOSS OF REGISTRY

BACKGROUND AND SUMMARY OF THE INVENTION

Manual silk screen printers are designed to print only a specific number of colors, and dimensionally unstable material, such as T-shirts, cannot be moved to a second printer if it is desired to print additional colors, because the shirt will move while it is being transferred and the subsequent colors will not be in registry with the previous colors. Thus, it is necessary for a silk screen print shop to have a printer that is capable of printing the maximum number of colors that will ever be required, even though most of the time a lesser number of colors will be printed. This is not cost effective because the greater the color capability of a printer, the greater its cost. For example, if a print shop occasionally printed shirts with eight colors but only required four colors on most jobs, it would have to buy an eight-color printer. However, an eight-color printer costs substantially more than a four-color printer, and the additional money would be better spent in purchasing two four-color printers which would double the production capability of the shop most of the time.

In addition, it often is desirable to perform non-silk screen processes between silk screen colors, and most non-silk screen processes require removing the material from the printer. However, because of their dimensional instability this cannot be done with shirts without loss of registry. Thus, it is not possible to perform a non-silk screen process between silk screen colors on a shirt.

An example of a non-silk screen process that needs to be performed between the printing of silk screen colors is the application of a foil coating. When a foil coating is applied on a shirt it does not adhere to the shirt itself but only to ink on the shirt. Thus, an undercoat is first applied to the shirt by silk screen that covers the area that is to have foil. The foil is applied onto this undercoat and then the colors are applied by silk screen. In addition, it often is desirable to apply airbrush or hand-painted art to a shirt between colors to obtain an effect that would not be available if the art was applied before or after all of the colors.

The subject invention overcomes the foregoing limitations of prior art silk screening of shirts by making the platen removable from the rest of the apparatus with the shirt affixed to it to perform the non-silk screen processes and still be replaceable on the same or another printer without disrupting the shirt, thereby allowing registry to be maintained. This is accomplished in a preferred embodiment of the invention by dividing the platen into a fixed bottom piece that is attached to the rest of the apparatus and a removable top piece that the shirt is adhesively attached to. The top and bottom pieces are indexed relative to one another so that registry is maintained when the top piece is removed and reinstalled on the bottom piece. In addition, the indexing secures the top piece immovable relative to the bottom piece when it is installed.

In a preferred embodiment this is accomplished by placing a plurality of projecting pins on the bottom piece and placing aligned holes in the top piece that snugly receive the pins. The pins are positioned uniformly on each bottom piece on every apparatus and the holes are positioned uniformly on every top piece. Thus, registry is maintained not only when a top piece is removed and reinstalled on the same bottom piece, but when it is installed on another bottom piece on the same apparatus or on a bottom piece on another apparatus. As a result, a top piece with a shirt attached can be removed from one apparatus to another in order to print more colors than would be possible with either apparatus alone, or a top piece can be removed from its bottom piece with the shirt attached to perform a non-silk screen process on the shirt and then reinstalled on the same bottom piece to finish the silk screen printing. In either case registry is maintained throughout the process.

Accordingly, it is a principal object of the subject invention to provide a multi-color silk screen printer for shirts in which the shirts can be removed from one printer and placed on another printer without loss of registry in order to print more colors than would be possible with either printer alone.

It is a further object of the subject invention to provide a silk screen printer having a platen which can be removed from the remainder of the apparatus with a shirt attached and then placed back on the apparatus without loss of registry between the shirt and the silk screens being carried by the apparatus.

It is a further object of the subject invention to provide a silk screen printer in which the shirts can be removed from the printer for performing non-silk screen processes and then placed back on the printer without loss of registry.

The foregoing and other objectives, features and advantages of the present invention will be more readily understood upon consideration of the following detailed description of the invention taken in conjunction with the accompanying drawings.

PREFERRED EMBODIMENT OF THE INVENTION

Figure 1:
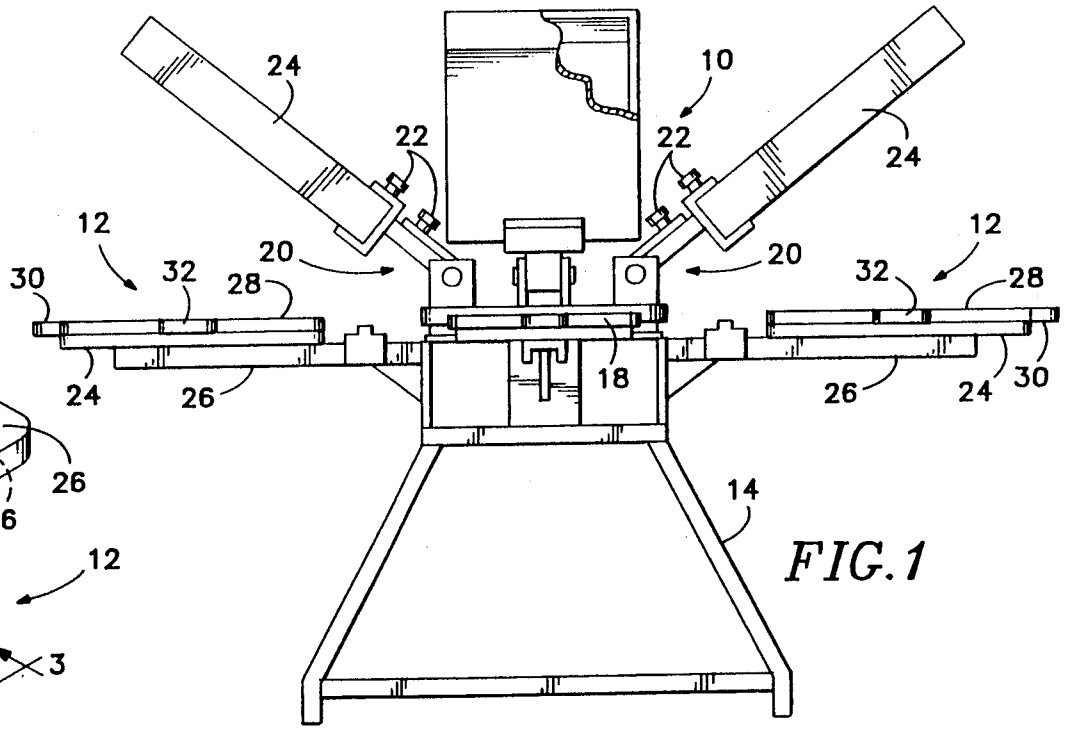
FIG. 1 is a side elevation view, partially broken away to show hidden detail, of a multi-color silk screen printer embodying the features of the subject invention.
Figure 3:
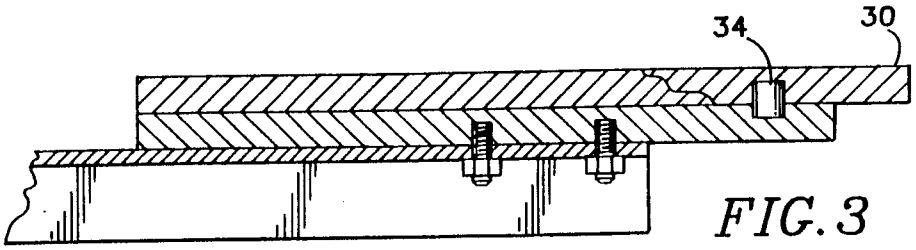
FIG. 3 is a sectional view taken along the lines 3—3 of FIG. 2.
Figure 2:
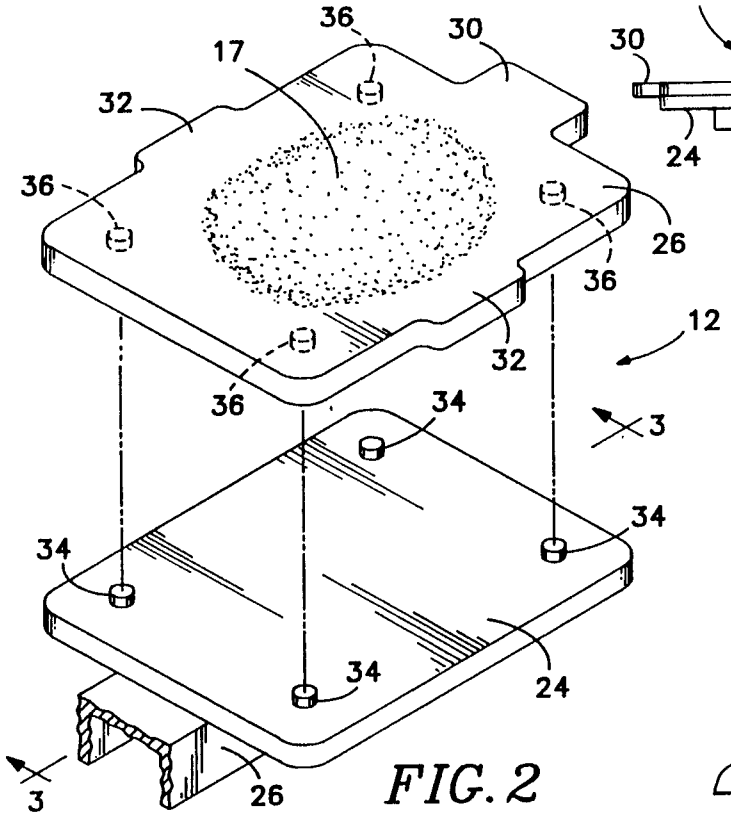
FIG. 2 an exploded view, at an enlarged scale, of the platen which is an element of the invention.
Figure 4:
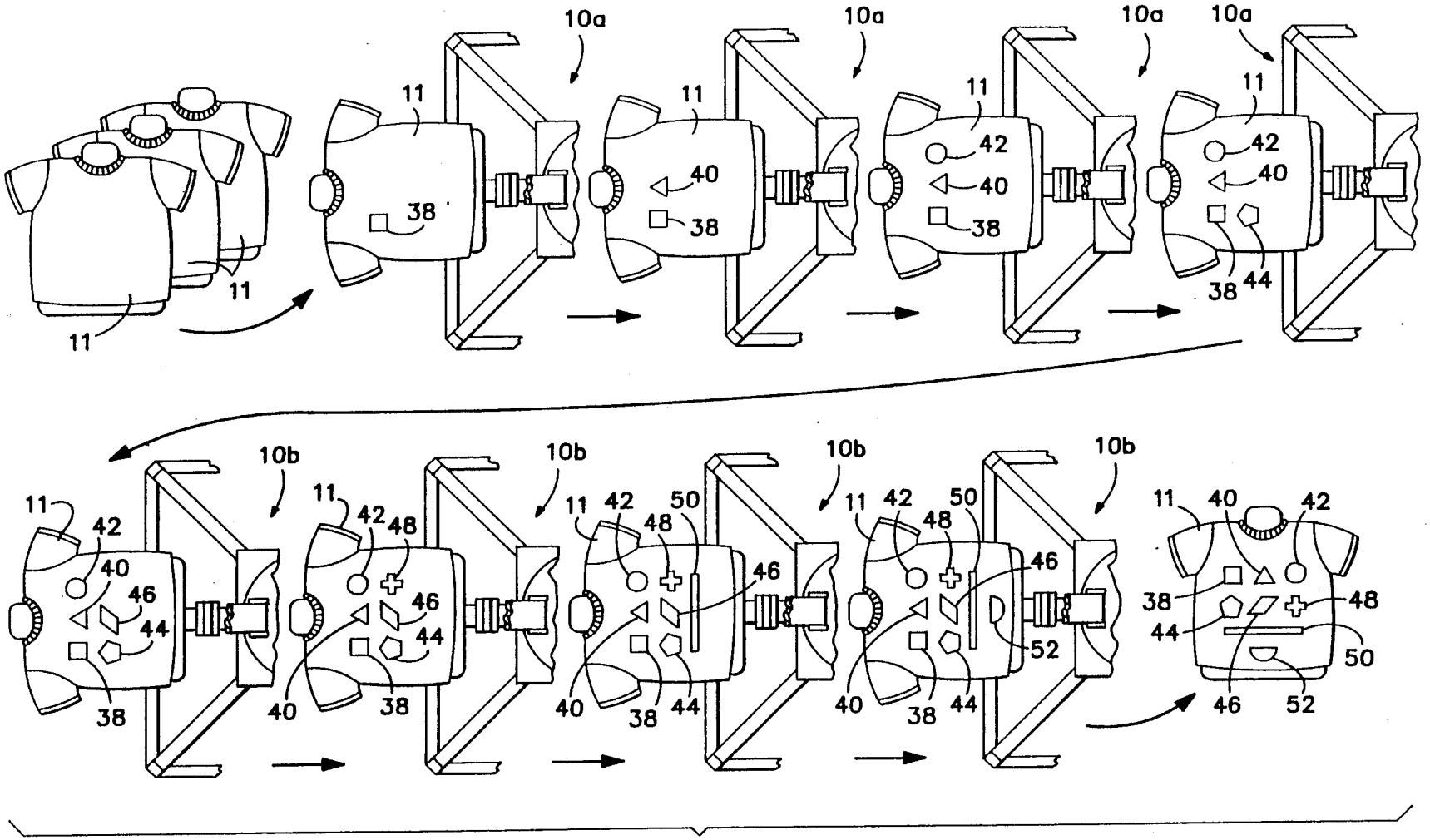
FIGS. 4 and 5 are schematic view showing two ways in which the subject invention is used.
Figure 5:
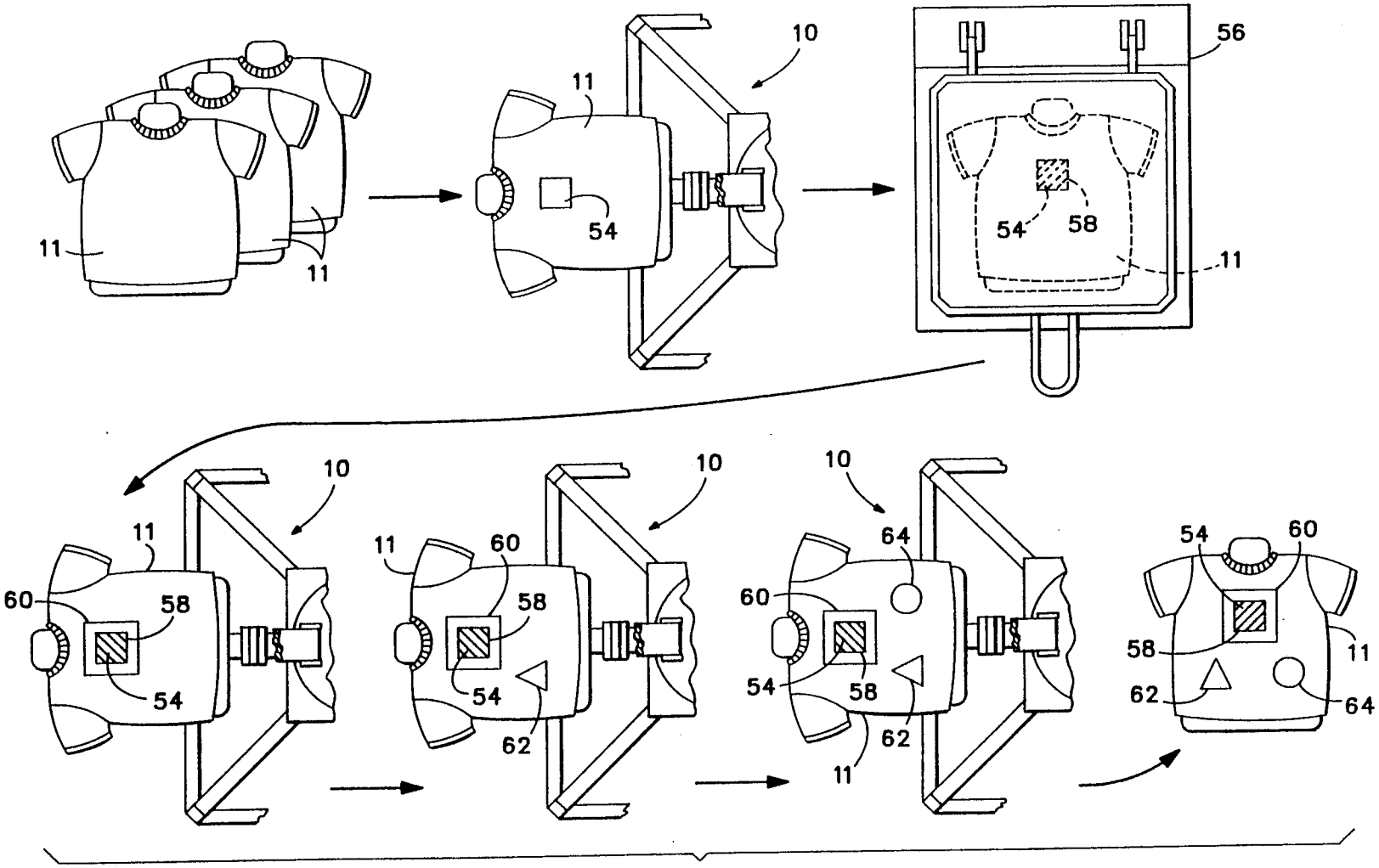

Shown in FIG. 1 is a multi-color, manually operated, silk screen printer 10 which is used for silk screen printing on dimensionally unstable material such as T-shirts 11 (FIGS. 4 and 5). The printer illustrated is a four-color machine but the invention is not limited in this regard. Printers of this type are well known in the prior art, an example being The Hopkins International Model 4-CL. The printer illustrated has a platen 12 that is rigidly attached to a frame 14. The platen 12 is configured to receive a T-shirt with the portion of its front or back that is to receive the printing being supported by the platen in a flat horizontal orientation. In order to prevent the dimensionally unstable T-shirt from moving during printing, a spray adhesive 17 (FIG. 2) is applied to the platen before the shirt is installed thereby affixing the shirt immovably to the platen. Also mounted on the frame 14 is a turntable 18 that has four silk screen holders 20 pivotally mounted to it at equally spaced locations. Each silk screen holder 20 includes adjustable clamps 22 that allow complete two dimensional adjustment of the silk screen 24.

The printer is used by mounting a silk screen 24 for printing one of the desired colors in each holder 20 and orienting them with the clamps 22 so that they are aligned or in registry with one another by using techniques that are well known in the industry. Printing occurs by lowering the silk screen holders sequentially onto the shirt and applying the ink, until all four colors have been applied. The shirt is then removed from the platen.

The foregoing aspects of the apparatus are old. The novelty resides in the platen 12 being removably attached to the remainder of the apparatus. In the preferred embodiment this is accomplished by dividing the platen into fixed and removable portions. Thus, the platen includes a bottom piece 24 which is rigidly attached to an arm 26 that is attached to the frame 14 and a top piece 28 which is configured to overlie the bottom piece and carry the shirt. The top piece has a protruding guide 30 on its outer edge that receives the neck of the T-shirt (FIGS. 4 and 5) to ensure that the shirt is centered on the platen. The top piece also has protruding handles 32 on each side to facilitate lifting the top piece off of the bottom piece. The top and bottom pieces contain a mutually engaging index device that permits them to be secured immovable relative to one another when joined, so that when the top piece is removed from and then replaced on the bottom piece, the two pieces will have the same alignment or registry that they did before they were separated. Thus, a shirt affixed to the top piece will have the same registry relative to the silk screen after replacement on the printer that it had before removal. Since all the platens on the printer are identical, registry will also be maintained if a top piece and shirt are moved from one bottom piece to another bottom piece on the same printer or to the bottom piece on a different printer. The indexing device illustrated in the drawings comprises aligned pins 34 and holes 36 that snugly interfit so as to prevent relative movement between the top and bottom pieces. Many other indexing devices would serve the same purpose as well.

Two methods for multi-color silk screen printing that are possible with the apparatus of the subject invention are illustrated by way of example. In the first method, shown in FIG. 4, the invention is utilized with two or more multi-station silk screen printers 10*a* and 10*b* and permits printing a shirt in more colors than would be possible with either printer alone. With this method an unprinted shirt is placed on the platen 12 of the first printer 10*a*, and a first color 38 is printed on the shirt. In the drawings the first color is shown as a square, but in practice it probably would be a portion of what will become a composite design. The turntable 18 is then rotated 90 degrees and a second color 40 (shown as a triangle), is printed on the shirt. The turntable is then rotated 90 degrees again and a third color 42 (shown as a circle) is printed on the shirt. Finally, the turntable is again rotated 90 degrees and the shirt is printed with a fourth color 42 (shown as a pentagon). The platen 12 is then separated by removing the top piece 28 with the shirt attached, and the top piece is installed on the bottom piece 24 of the platen of the second printer 10*b*. The fifth, sixth, seventh and eighth colors 46, 48, 50 and 52, respectively, are then printed on the shirt with the second printer in the same manner that the first through fourth colors were printed with the first printer.

Since the shirt remains immovably attached to the top piece and the top piece is attached to the bottom piece on both the first and second printer, registry is maintained throughout the entire printing process. This assumes that all of the silk screens on the first and second printers were oriented to be in registry with one another, which can be accomplished in the same manner that is used to obtain registry between all of the silk screens on a single printer.

In the second method for using the invention, shown in FIG. 5, only one printer is used and the shirt is removed from the printer between colors in order to perform a non-silk screen process that needs to be made between printing the colors. The non-silk screen process can include, for example, foil coatings, airbrush art, or hand-painted art. The process shown in FIG. 5 uses foil coating as the non-silk screen process. An undercoat 54 is placed on the shirt and the top piece of the platen with the shirt attached is then removed and placed in a heat transfer machine 56 where the foil coating 58 (shown as cross-hatching) is applied on the undercoat 54. The top piece of the platen is then reinstalled on the bottom piece that it was removed from and the first, second and third colors 60, 62 and 64, respectively, are printed in the normal manner. As with the first method, registry between the colors and foil is automatically maintained.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for making multi-color silk screen prints on dimensionally unstable material comprising:

(a) providing two or more multi-station silk screen printing apparatus each capable of printing less than the number of colors that are to be printed;

(b) providing one or more platens on each of said apparatus said platens each having a fixed portion and a removable portion;

(c) fixedly attaching the material to the removable portion of one of said platens on the first of said apparatus;

(d) printing all of the colors possible with said first apparatus;

(e) thereafter removing the removable portion containing the material from said first apparatus, with the material affixed thereto, and attaching it to the fixed portion of a second apparatus;

(f) printing additional colors on said material with said second apparatus; and (g) repeating steps (e) and (f) on additional apparatus until the printing is completed.

2. The method of claim 1 including the step of providing aligned indexing pins and holes on said fixed and removable portions respectively, for removably joining said fixed and removable portions to one another with repeatable registry therebetween.

3. A method for making multi-color silk screen prints on a dimensionally unstable material with non-silk screen processes being applied to said material between selected silk screen colors comprising:

(a) providing a multi-station silk screen printing apparatus;

(b) providing one or more platens on said apparatus, said platens each having a fixed portion and a removable portion;

(c) fixedly attaching the material to the removable portion of one of said platens;

(d) printing a portion of the colors on the material;

(e) thereafter removing said removable portion from said apparatus with the material affixed thereto, and performing the non-silk screen process on the material while it remains affixed to said removable portion; and (f) reattaching said removable portion with said material still affixed thereto on said fixed portion and printing the remainder of said colors.

4. The method of claim 3 including the step of providing aligned indexing pins and holes on said fixed and removable portions respectively, for removably joining said fixed and removable portions to one another with repeatable registry therebetween.

* * * * *